United States Patent [19]

Pringle

[11] Patent Number: 4,621,695

[45] Date of Patent: Nov. 11, 1986

[54] BALANCE LINE HYDRAULICALLY OPERATED WELL SAFETY VALVE

[75] Inventor: Ronald E. Pringle, Houston, Tex.

[73] Assignee: Camco, Incorporated, Houston, Tex.

[21] Appl. No.: 644,183

[22] Filed: Aug. 27, 1984

[51] Int. Cl.[4] ..... E21B 34/10

[52] U.S. Cl. ..... 166/321; 166/324; 166/325; 251/63.4

[58] Field of Search ..... 166/72, 324, 321, 319, 166/332, 325, 323; 251/63.4, 62

[56] References Cited

U.S. PATENT DOCUMENTS

| | | | |
|---|---|---|---|
| 3,854,502 | 12/1974 | Mott | 166/324 |
| 4,062,406 | 12/1977 | Akkerman et al. | 166/323 |
| 4,069,871 | 1/1978 | Page, Jr. | 166/321 |
| 4,149,698 | 4/1979 | Deaton | 166/324 X |
| 4,161,219 | 7/1979 | Pringle | 166/324 |
| 4,407,363 | 10/1983 | Akkerman | 166/183 |
| 4,522,370 | 6/1985 | Noack et al. | 166/324 X |

OTHER PUBLICATIONS

"Wellguard II, Surface-Controlled Subsurface Safety Valve System", published by Hydril.

*Primary Examiner*—Stephen J. Novosad
*Assistant Examiner*—Hoang C. Dang
*Attorney, Agent, or Firm*—Fulbright & Jaworski

[57] ABSTRACT

A well safety valve controlling flow through a well tubing using a hydraulic control line extending from the well surface to one side of an actuating piston and cylinder assembly for opening the valve. A balance line extending to the second side of the piston and cylinder assembly for compensating for the hydrostatic pressure in the control line. The piston and cylinder assembly includes a check valve providing communication of hydraulic fluid from the balance line to the control line for purging the balance line of gas. A second piston and cylinder assembly is positioned adjacent to and actuated by the first piston cylinder assembly. The cross-sectional area of the piston of the first assembly is greater than the cross-sectional area of the piston of the second assembly whereby a lower surface operating pressure in the control line on the larger first assembly will open the valve. The closing force acts through the smaller second assembly to close the valve.

5 Claims, 8 Drawing Figures

BALANCE LINE HYDRAULICALLY OPERATED WELL SAFETY VALVE

BACKGROUND OF THE INVENTION

As well safety valves which are controlled by a hydraulic control line extending to the well surface are set at greater depths, the hydrostatic head in the control line increases. This requires higher closing forces to overcome the hydrostatic head pressures at a given depth. This has been achieved in the past, as shown in U.S. Pat. No. 4,161,219 by providing a strong spring biasing force for closing the valve and providing a small area hydraulic piston and cylinder assembly. However, with high spring rates and relatively long travel to open the valve, the surface operating pressures can become excessive and are required to be extremely high in the event that the tubing pressure which also biases the valve to a closed position is close to the rated well tree pressure.

Also in the past, in an attempt to overcome the hydrostatic head problem in the control line, two lines were connected from the well surface to the valve. One of the lines is the control line to control the opening and closing pressure of the valve and the second line is to balance the hydrostatic head pressure. However, gas from the well migrates into the balance line past the various seals in the valve and lowers the density of the counterbalancing fluid in the balance line. In this event, the hydrostatic head in the control line, which is then unbalanced, opens the valve and the biasing closing forces cannot close the valve. Therefore, with gas in the balance line, the valve will fail in the open position which is undesirable. One feature of the present invention is to overcome the problem of gas migrating into the balance line.

While it is desirable to have a high closing pressure in order to insure that the safety valve will be able to close when needed, it is undesirable that the surface operating pressure in the control line be overly high. Another feature of the present invention is to provide a safety valve having a low opening pressure and a high closing pressure.

SUMMARY

The present invention is directed to a well safety valve for controlling the fluid flow through a well conduit and includes a tubular housing and a valve closure member moving between open and closed positions. A longitudinal tubular member is telescopically movable in the housing for controlling the movement of the valve closure member. Biasing means are provided for biasing the tubular member in a direction to cause the valve to close. A piston and cylinder assembly is positioned in the housing for moving the tubular member to an open position. One side of the assembly is adapted to be connected to a hydraulic control line extending to the well surface for opening the valve. The other side of the assembly is adapted to be connected to a hydraulic balance line extending to the well surface for compensating for the hydrostatic pressure in the control line. One feature of the present invention is the provision of a check valve between the balance line and the control line, such as in the piston and cylinder assembly for providing communication of hydraulic fluid from the balance line to the control line for purging the balancing line of any gas therein. The check valve prevents communication of hydraulic fluid from the control line to the balance line thereby allowing the assembly to be actuated to open the valve.

Still a further object of the present invention is the provision of a well safety valve having a low opening pressure and a high closing pressure. A first larger piston and cylinder assembly is positioned in the housing and is adapted to be connected on one side to a hydraulic control line extending to the well surface and is adapted to be connected on a second side to a hydraulic balance line extending to the well surface. A second smaller piston and cylinder assembly is positioned adjacent the first assembly and is connected to a tubular member for opening the valve. A low surface operating pressure in the control line acting against the larger first piston and cylinder assembly will cause the safety valve to be moved to the open position. When the control line pressure is released, the hydrostatic head pressure is equaled on both sides of the large piston and cylinder assembly. At this time, the smaller piston and cylinder assembly may be closed at high closing pressure and overcome the hydrostatic pressure.

Yet a still further object of the present invention is the provision of a well safety valve for controlling the fluid flow through a well conduit having a tubular housing, a valve closure member in the housing movable between open and closed positions with a longitudinal tubular member telescopically movable in the housing for controlling the movement of the valve member. Means are provided for biasing the tubular member in a first direction for causing the valve closure member to move to the closed position. An annular piston and cylinder assembly is positioned in the housing and the housing includes a port adapted to be connected to a hydraulic control line extending to the well surface for communication with one side of the assembly for moving one of the annular piston and cylinder in an opening direction. The housing includes a second port adapted to be connected to a hydraulic balance line extending to the well surface and communicating with the other side of the annular piston and cylinder assembly for compensating for the hydrostatic pressure in the control line. A rod piston and cylinder assembly is positioned in the housing and one of the rod piston and cylinder is connected to the tubular member and the other is engagable by the annular piston and cylinder assembly for opening the valve in response to hydraulic pressure in the control line. The cross-sectional area of the annular piston is greater than the cross-sectional area of the rod piston whereby lower surface operating pressure in the control line will open the valve. When the annular piston and cylinder assembly is balanced, the closing forces acting through the smaller rod piston and cylinder assembly will close the valve.

A still further object of the present invention is wherein the annular piston and cylinder assembly includes a check valve providing communication of hydraulic fluid from the balance line to the control line for purg:ng the balance line of gas.

Other and further objects, feature and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
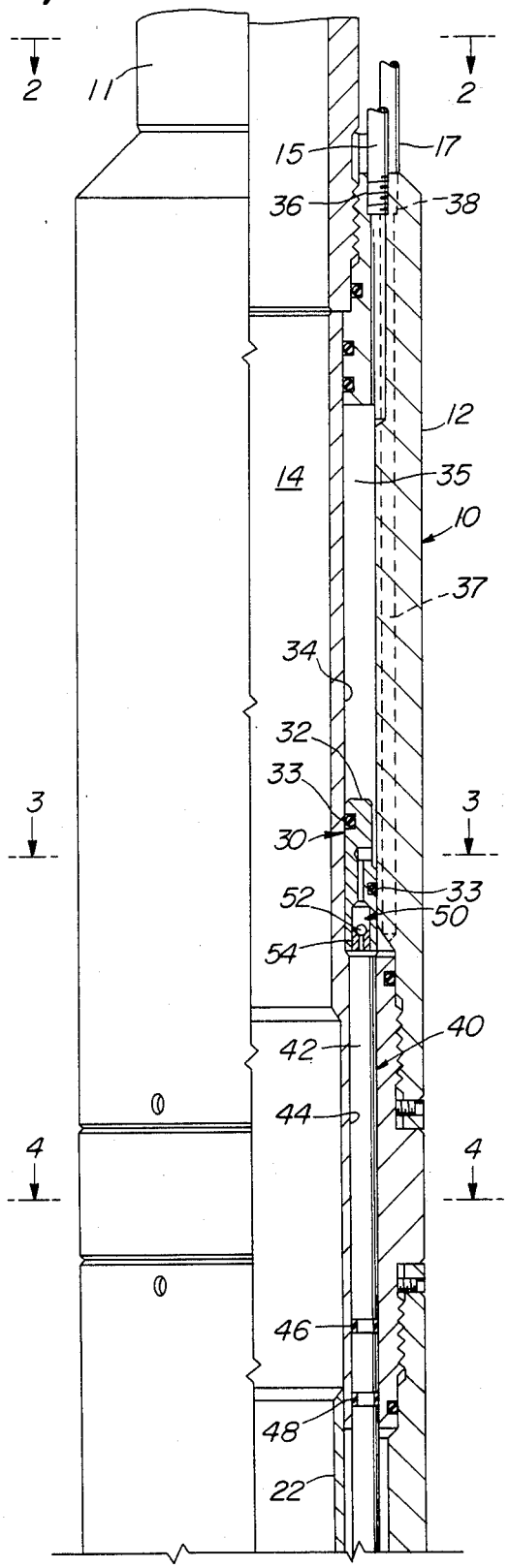
FIGS. 1A, 1B, 1C and 1D are continuations of each other and are fragmentary elevational views, in quarter section, of a well safety valve embodying the present invention.

While the present improvement in a subsurface well safety valve will be shown, for purposes of illustration only, as incorporated in a flapper type tubing retrievable safety valve, it will be understood that the present invention may be used with other types of safety valves and safety valves having various types of valve closing elements.

Referring now to the drawings, particularly to FIGS. 1A-1D, the subsurface safety valve of the present invention is generally indicated by the reference numeral 10 and is shown as being of a nonretrievable type for connection in a well conduit or well tubing 11 such as by threaded connections. The safety valve 10 generally includes a tubular body or housing 12 adapted to be connected in a well tubing to form a part thereof and to permit well production therethrough under normal operating conditions, but in which the safety valve 10 may close or be closed in response to abnormal conditions such as might occur when the well overproduces, blows wild or in the event of failure of well equipment.

The safety valve 10 generally includes a bore 14, an annular valve seat 16 positioned about the bore 14, a valve closure element or flapper valve 18 connected to the body 12 by a pivot pin 20 which is urged to a seating position by a spring 24. Thus, when the flapper valve 18 is in the upper position and seated on the valve seat 16, the safety valve 10 is in a closed position blocking flow upwardly through the bore 14 in the well tubing 11. A sliding tube or longitudinal tubular member 22 is telescopically movable in the body 12 and through the valve seat 16.

Figure 1B:
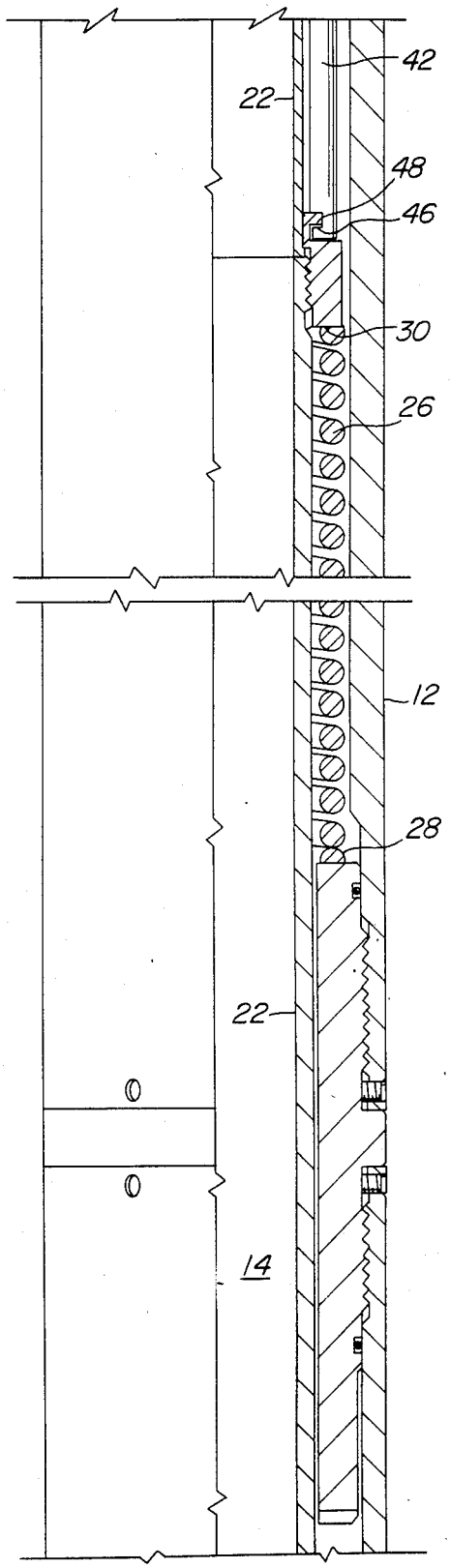
Figure 1C:
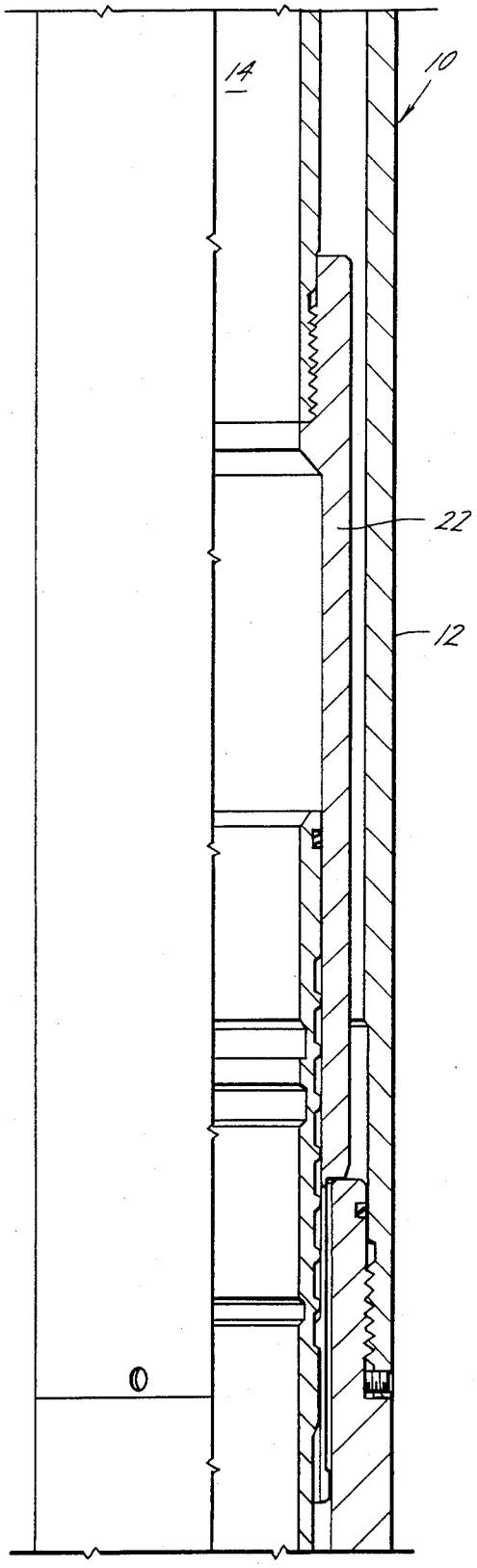
Figure 1D:
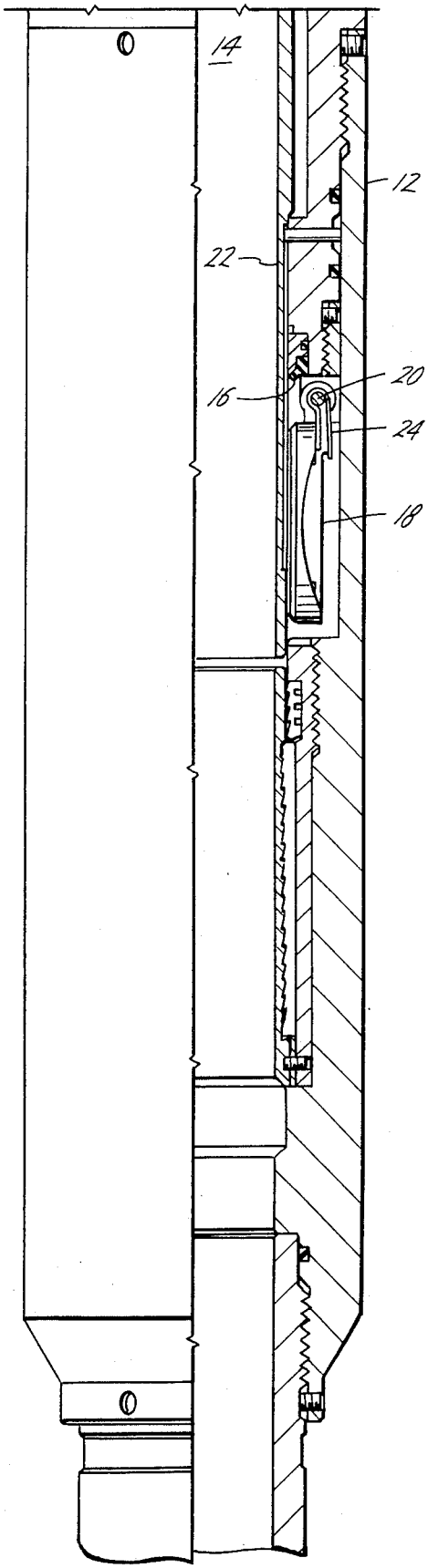

As best seen in FIG. 1D, when the tubular member 22 is moved to a downward position, the member 22 pushes the flapper 18 away from the valve seat 16. Thus the valve 10 is held in the open position so long as the member 22 is in the downward position. When the tubular member 22 is moved upwardly, the flapper 18 is allowed to move upwardly onto the seat 16 by the action of the spring 24 and also by the action of the fluid flow moving upwardly through the well bore 14 of the body 12.

Various forces are provided to act on the tubular member 22 to control its movement so that under operating conditions the tubular member 22 will be in the downward position holding the flapper 18 away from and off of the valve seat 16 so that the valve 10 will be open. When desired, or when abnormal conditions occur, the tubular member 22 will be moved upwardly allowing the flapper 18 to close shutting off flow through the valve 10 and well tubing 11. Thus, biasing means such as a spring 26 or a pressurized chamber (not shown) may act between a shoulder 28 on the valve body 12 and a shoulder 30 connected to the tubular member 22 for yieldably urging the tubular member 22 in a upward direction to release the flapper 18 for closing the valve 10.

U.S. Pat. No. 4,161,219 describes a well safety valve having a small piston cross-sectional area which reduces the hydrostatic head forces so that the valve can be utilized at greater depths in a well and yet allow the biasing forces and tubing pressure forces acting on the piston to close the valve. However, in the event that the tubing pressure is high and close to the rated tree pressure at the well surface, the operating pressure in the control line may become excessive.

Figure 2:
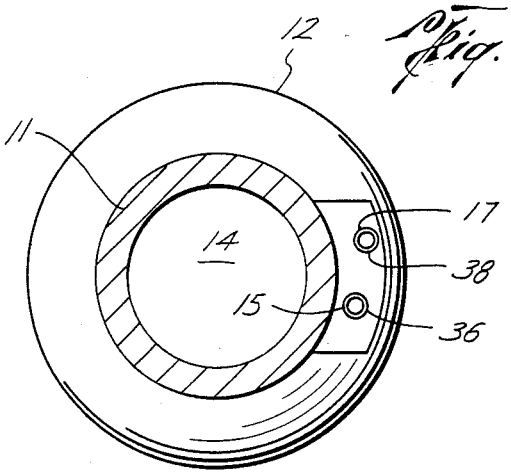
FIG. 2 is a cross-sectional view taken along the line 2—2 of FIG. 1A.
Figure 3:
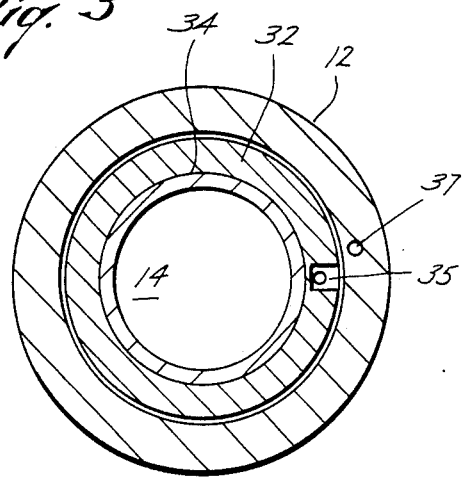
FIG. 3 is a cross-sectional view taken along the line 3—3 of FIG. 1A.

Therefore, one feature of the present invention is to provide a hydraulically actuated safety valve with a low opening pressure and a high closing pressure. Referring now to FIGS. 1A, 2 and 3, a first piston and cylinder assembly generally indicated by the reference numeral 30 is provided such as a piston 32 movable in a cylinder 34. For example, the piston 32 may be an annular piston telescopically moving in the annular cylinder 34. One side of the piston and cylinder assembly 30 is in communication through a passageway 35 with a port 36 which is adapted to be connected to a hydraulic control line 15 extending to the well surface for moving one of the piston 32 and cylinder 34, here the piston 32, in a direction for opening the valve 10. The second side of the piston and cylinder assembly 32 is in communication with a second port 38 through a passageway 37. The port 38 is adapted to be connected to a hydraulic balance line 17 extending to the well surface for compensating for the hydrostatic pressure in the control line 15. That is, the piston 32 includes seals 33 and the hydraulic control line 15 through the port 36 and passageway 35 acts on the top side of the piston seals 33 while the balance line 17 acts through the port 38 and passageway 37 on the bottom side of the piston seals 33. The piston 32 by being annular may have a large cross-sectional area. Therefore, a low opening pressure exerted through the control line 15 and port 36 on the top of the piston 32 creates a large force for opening the valve 10 as will be more fully described hereinafter. However, when the pressure in the control line in port 36 is released, the hydrostatic head on both sides of the piston 32 is equal and thus is unaffected by its setting depth.

Figure 4:
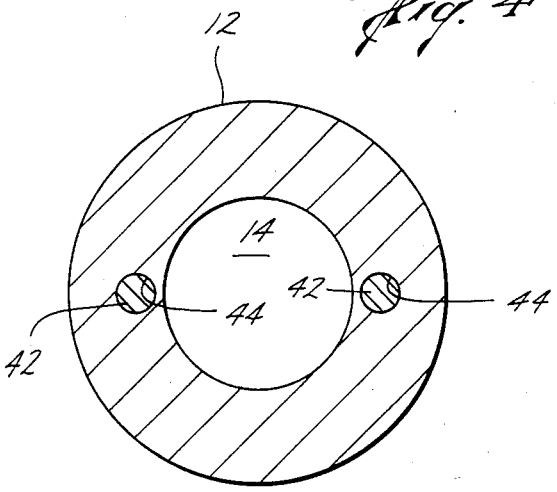
FIG. 4 is a cross-sectional view taken along the line 4—4 of FIG. 1A.
Figure 5:
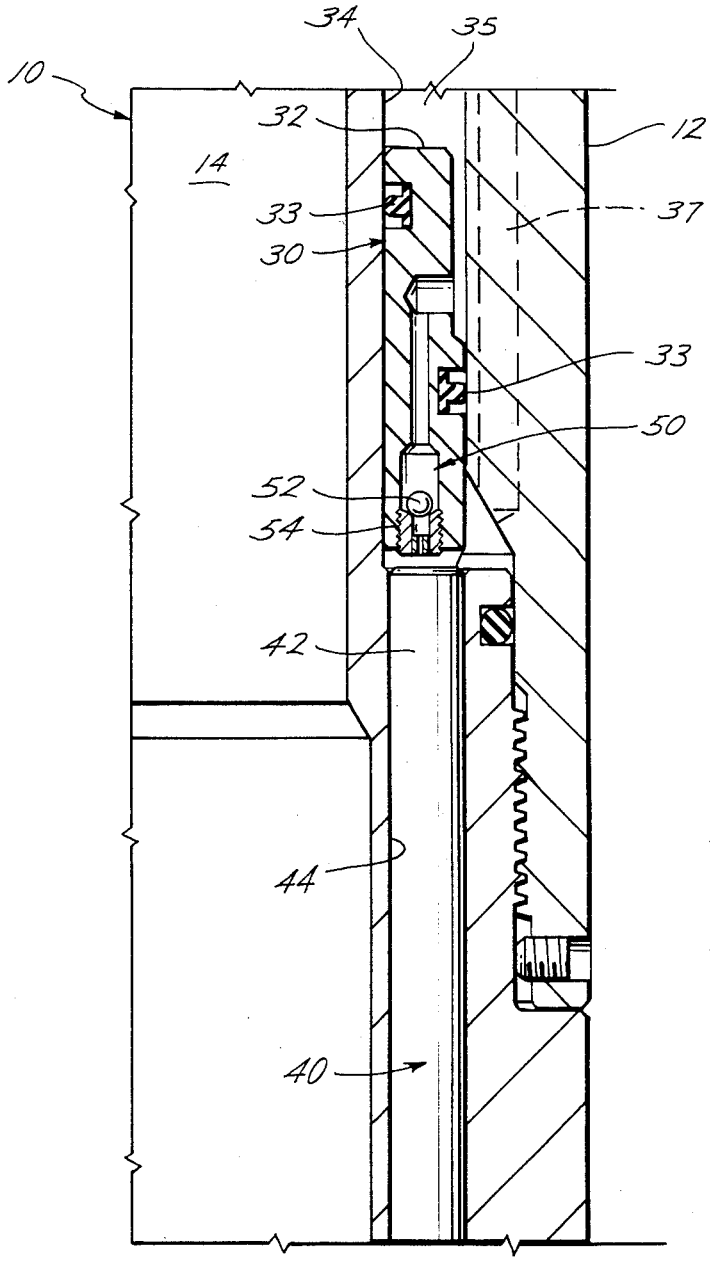
FIG. 5 is an enlarged cross-sectional view of the check valve shown in FIG. 1A.

Referring now to FIGS. 1A, 1B and 4, a second piston and cylinder assembly generally indicated by the reference numeral 40 includes one or more pistons 42 movable in cylinders 44. One of the piston and cylinder is connected to the flow tube 22 such as the piston 42 by coacting shoulders 46 and 48. The pistons 42 include seals 46 and 48. One of the piston and cylinder such as the pistons 42 is positioned adjacent the upper piston and cylinder assembly 30 such as to be engagable by the piston 32. Thus, when pressure is applied to the control line 15, port 36 and passageway 35 onto the top of the piston 32, the piston 32 moves downwardly, engages the pistons 42 to move them downwardly and carry the flow tube 22 through the valve seat 16 and open the flapper 18.

The cross-sectional area of the pistons 42 are much smaller than the cross-sectional area of the piston 32, for example, in the range of 10 to 1. Therefore, even though the piston 42 is being urged upwardly by the biasing spring 26 and the pressure in the tubing bore 14, which flows around the flow tube 22 and acts against the bottom of the piston 42, the larger hydraulic piston 32 only requires a small opening force to open the valve 10. In order to close the valve 10, the pressure in the control line 15 is released and thus the hydrostatic pressure in each of the passageways 35 and 37 is equal on opposite sides of the larger piston 32. Thus the piston 32 can be easily moved. Therefore, the force of the biasing spring 26 and the force of the tubing pressure in the bore 14 acting against the bottom of the pistons 42 will provide a relatively high closing pressure to overcome the hydrostatic head.

However, while the balance line 17 and passageway 37 conveniently balance the annular piston 32 against the hydrostatic head in the passageway 35 and control line 15 and allow the use of the valve 10 at great depths, the passageway 37 and balance line 17 is subject to accumulating gas from the well and bore 14 which migrates through the various seals and reduces the density of the hydraulic fluid in the line 37 and balance line 17. If this occurs, the fluid in the balance line and passageway 37 will no longer compensate for the hydrostatic pressure in the control line 15 and passageway 35 and the greater hydrostatic head in the control line 15 and passageway 35 will force the annular piston 32 downwardly opening the valve 10. The valve will then fail in the open mode as the closing pressures would be unable to overcome the uncompensated hydrostatic head above the piston 32. To eliminate this problem, a check or purge valve generally indicated by the reference numeral 50, is provided such as in the piston 32 to allow communication of hydraulic fluid from the balance line 17, port 38, and passageway 37 through the check valve 50 and into the passageway 35. That is, the check valve 50 includes a spring loaded valve element or ball 52 which seats on a valve seat 54. Therefore, fluid may be pumped down the balance line 17 and through the check valve 50 and into the control line 15 to purge the balance line 17 of any gas therein. However, the check valve 50 will close and prevent communication of hydraulic fluid from the control line 15 to the balance line 17 whereby the piston and cylinder assembly 30 may be actuated to open the valve 10. While the check valve 50 is shown in piston 32, it may be connected between the balance line 17 and the, control line 15 at any suitable location close to the valve 10 for purging the line 17.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In a well safety valve for controlling the fluid flow through a well conduit and including a tubular housing and a valve closure member moving between open and closed positions, a longitudinal tubular member telescopically movable in the housing for controlling the movement of the valve closure member, means for biasing the tubular member in a first direction for causing the valve closure member to move to the closed position, a piston and cylinder assembly positioned in the housing for moving the tubular member, one side of the assembly adapted to be connected to a hydraulic control line extending to the well surface for moving the valve closure member to the open position, the other side of the assembly adapted to be connected to a hydraulic balance line extending to the well surface for compensating for the hydrostatic pressure in the control line, the improvement comprising, a check valve providing communication of hydraulic fluid from the balance line to the control line for purging the balance line of any gas, but preventing communication of hydraulic fluid from the control line to the balance line whereby the assembly may be actuated to open the valve.

2. In a well safety valve for controlling the fluid flow through a well conduit and including a tubular housing and a valve closure member moving between open and closed positions, a longitudinal tubular member telescopically movable in the housing for controlling the movement of the valve closure member, means for biasing the tubular member in a first direction for causing the valve closure member to move to the closed position, a piston and cylinder assembly positioned in the housing for moving the tubular member, one side of the assembly adapted to be connected to a hydraulic control line extending to the well surface for moving the valve closure member to the open position, the other side of the assembly exposed to a port adapted to be connected to a hydraulic balance line extending to the well surface for compensating for the hydrostatic pressure in the control line, the improvement comprising, a second piston and cylinder assembly positioned adjacent the first piston and cylinder assembly but on the other side of said port from the first piston and cylinder assembly and connected to the tubular member, said second assembly engaged by the first assembly for opening said valve, and the cross-sectional area of the piston of the first assembly being greater than the cross-sectional area of the second assembly whereby a lower surface operating pressure in the control line acting on the larger first assembly will open the valve, and the means for biasing the tubular member acts through the smaller second assembly to close the valve.

3. The apparatus of claim 2 wherein the first assembly includes a check valve providing communication of hydraulic fluid from the balance line to the control line for purging the balance line of any gas, but preventing communication of hydraulic fluid from the control line to the balance line whereby the first assembly may be actuated to open the valve.

4. A well safety valve for controlling the fluid flow through a well conduit comprising, a tubular housing, a valve closure member in the housing movable between open and closed positions, a longitudinal tubular member telescopically movable in the housing for controlling the movement of the valve closure member, means for biasing the tubular member in a first direction for causing the valve closure member to move to the closed position, an annular piston and cylinder assembly positioned in the housing, said housing including a port adapted to be connected to a hydraulic control line extending to the well surface for communication with one side of the assembly for moving one of the annular piston and cylinder in a second direction, said housing including a second port adapted to be connected to a hydraulic balance line extending to the well surface and communicating with the other side of the annular piston and cylinder assembly for compensating for the hydrostatic pressure in the control line, a rod piston and cylinder assembly positioned in the housing, one of said rod piston and cylinder connected to the tubular member and the other engagable by the annular piston and cylinder assembly for opening the valve in response to hydraulic pressure in the control line, and the cross-sectional area of the annular piston being greater than the cross-sectional area of the rod piston whereby a lower surface operating pressure in the control line will open the valve.

5. The apparatus of claim 4 including, said annular piston and cylinder assembly including a check valve providing communication of hydraulic fluid from the balance line to the control line for purging the balance line of any gas, but preventing communication of fluid from the control line to the balance line whereby the annular assembly may be actuated to open the valve.

* * * * *